US005337810A

United States Patent [19]

McCormack

[11] Patent Number: 5,337,810

[45] Date of Patent: Aug. 16, 1994

[54] MODIFIED WOOD SPLITTER

[76] Inventor: Edward B. McCormack, P.O. Box 30, West Rutland, Vt. 05777

[21] Appl. No.: 187,864

[22] Filed: Jan. 28, 1994

[51] Int. Cl.[5] ..... B27L 7/00

[52] U.S. Cl. ..... 144/193 A; 144/193 R; 144/193 E; 144/366; 144/193 F; 414/540

[58] Field of Search ..... 414/540; 144/3 K, 193 R, 144/193 A, 193 E, 193 F, 366

[56] References Cited

U.S. PATENT DOCUMENTS 3,077,214 2/1963 Brukner ..... 144/193 A 3,242,955 3/1966 Hellstrom ..... 144/193 A 4,596,279 6/1986 Taylor ..... 144/193 E 4,961,452 10/1990 Hudson ..... 144/193 E

*Primary Examiner*—W. Donald Bray

*Attorney, Agent, or Firm*—John J. Welsh, Jr.

[57] ABSTRACT

The instant device is a modified wood splitter featuring a hydraulically controlled log elevator, a log splitting piston stroke control rod, an adjustable four-way splitting wedge and a generator mounting apparatus all of which said features have been added to, for a significant improvement upon a conventional power driven wood splitter.

9 Claims, 11 Drawing Sheets

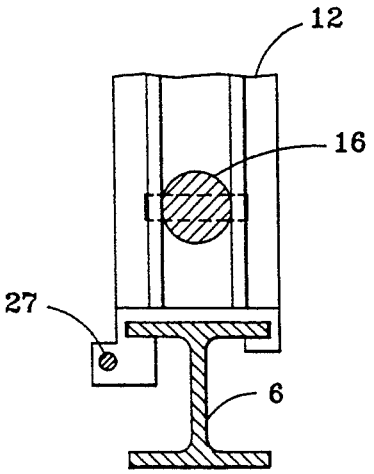
FIG. 17
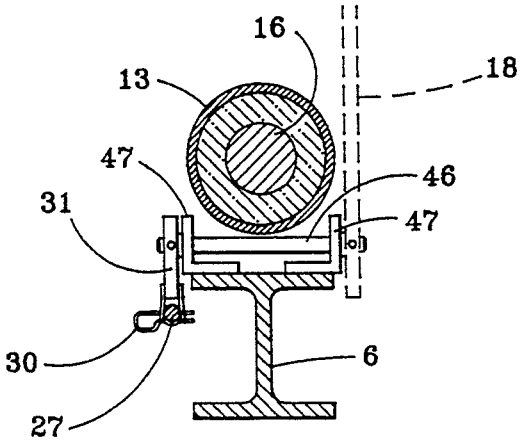
FIG. 18
FIG. 19
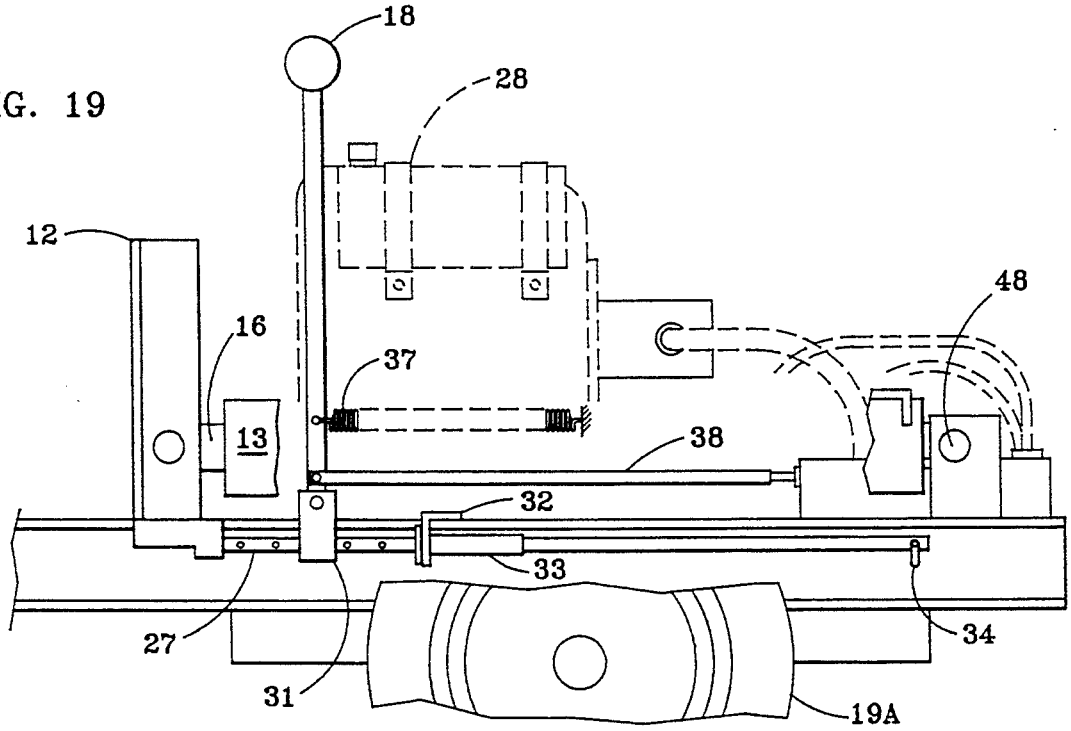
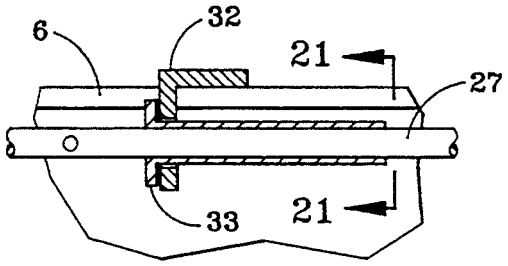
FIG. 20
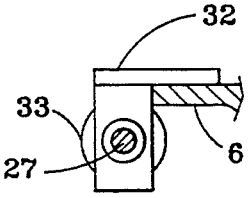
FIG. 21

MODIFIED WOOD SPLITTER

BACKGROUND OF THE INVENTION

1. Field of the Invention

The instant invention relates to woodsplitting devices especially those utilized by individual homeowners.

2. Possible Prior Art

The following references are cited with the view however that the same do not constitute prior art such as would serve to anticipate the claims set forth in the instant application for letters

| Inventor | Patent | U.S. Pat. No. | Date |
|---|---|---|---|
| 1. Reini | Log Lifter for Log Splitter | 4,544,008 | 10/1/85 |
| 2. Wech, Jr. et al | Log Lifter | 4,431,362 | 2/14/84 |
| 3. Meyer | Log Splitter Improvements | 4,842,030 | 6/27/89 |
| 4. Brace | Woodsplitting Head Assembly | 4,860,806 | 8/29/89 |
| 5. Rattray | Hydraulic Log Splitting Attachment for a Tractor | 4,240,476 | 12/23/80 |
| 6. Larson | Log Splitter for Garden Tractors | 4,278,118 | 7/14/81 |
| 7. Scarbrough, Jr. | Log Splitter with Rapid Return Hydraulic Cylinder | 4,615,366 | 10/7/86 |
| 8. Kinig et al. | Hydraulic Log Splitter Attachment for Farm Tractors and Industrial Tractors | 4,153,088 | 5/8/79 |
| 9. Phelps et al. | Log Splitter | 4,293,013 | 10/6/81 |

A SUMMARY OF THE INVENTION

A Brief Description of the Invention

The instant invention is a conventional woodsplitter that consists however of a number of modifications each of which serve to render it inherently unique. The first of such variations is an adjustable four-way woodsplitter wedge component mounted at the front of the track along which logs to be split are pushed. The second of such variations is a log lifting assembly that is hydraulically powered which is mounted adjacent to the track along which logs to be split are pushed. The third of such variations is a stroke control rod with accompanying positioning pin which is attached to the head of the shaft of the device's woodsplitting piston and held in situ along a track below the level of the woodsplitting piston's housing but running parallel to the direction of the shaft of the piston which pushes logs along the track upon which they are to be split. Part and parcel of this variation is a spring loaded lever with, in conjunction with the device's hydraulics, forward, neutral and reverse capability with regards to actuating the device's woodsplitting piston. Finally, the fourth of such variations is a feature whereby the device is able to accommodate a generator serving to develop electrical power in emergencies involving power outages in a home setting by way of a belt assembly amenable to being attached to the device's gas driven motor.

The above-mentioned four-way splitting wedge is adjustable by way of a lever mounted on it that facilitates upward and downward adjustment of the position of its horizontal wedge component. The lever in terms of its manner of operation makes this variation indeed new and unique. This feature is moreover especially useful in that it permits quick, ready four-way splitting of logs of many varying diameters. The device's log lifting assembly is likewise especially useful in that it permits the loading of large, heavy logs onto the device's splitting track with no need for the user to have to risk back injury by otherwise being required to lift such logs manually onto the track from ground level. Also, if the splitter is to be hauled anywhere requiring the initial dismantling of its front-end support post, the elevator at ground level will hold the device erect and obviate the need to lift the device through a distance equal to height of the post after it would have otherwise dropped to ground level upon removal of the post. This variation in terms of its construction and manner of operation is also new and unique. These two features together render the device readily usable by even a frail, elderly person who would not be capable of utilizing woodsplitters currently in existence or in vogue. The device's stroke control system is especially useful in that it serves to greatly speed up the process of log splitting. This variation enables the resting position of the head of the shaft of the device's woodsplitting piston to be preset to a location just beyond the length of a set of logs to be split. Hence, the piston moves forward from this position to push a held log into the wedge when the spring loaded lever is pushed forward by the device's operator. Once splitting is finished, the lever is released, the spring pulls it back to a reverse position and the piston reverses direction. But, instead of going way back to an otherwise constant rest position, it goes back only as far as desired by the operator, to wit, only back to its preset rest position. Its reverse movement is constrained by virtue of placement of a pin in a hole in the stroke control rod running parallel to and below the device's splitting track but connected to the head of the shaft of the device's splitting piston. Once back to the desired rest position, the pin catches the spring loaded lever and causes it to pivot forward enough to go from reverse to neutral and stop the reverse movement of the piston. This variation is truly revolutionary within the field of woodsplitting devices. It enables the time required for splitting to be greatly shortened. The usefulness of the device's capability with respect to accommodating a generator would be particularly apparent in the event of a very bad electrical and/or windstorm or blizzard that would have knocked out electrical power for a significant period of time in the area of the house or building where the device would be stored.

Each of the abovesaid variations, as has been previously asserted, is, respectfully submitted, new, useful and indeed unique especially in terms of the manner in which each is constructed and operated; and each in conjunction with a basic woodsplitter represents in and of itself a significant improvement upon and departure from the current art involving woodsplitters. But, a combination of more than one of these variations especially all of them truly constitutes a radical departure in a highly positive way from the teachings of such current art.

A DESCRIPTION OF THE DRAWINGS

FIG. 17 is a sectional view showing the instant device's splitting piston head mounted to a piston rod and to the instant device's splitting track. Therein is also seen a sectional view of the instant device's stroke control rod and a view of its insertable positioning pin.

FIG. 18 is a sectional view showing in isolation the instant device's stroke control lever in position relative to the instant device's piston and housing, stroke control track and stroke control rod.

FIG. 19 shows in isolated plan view, the instant device's stroke control lever and the manner in which it is spring loaded. Also seen therein is the rod leading from the lever to hydraulic controls as well as the permanent stop piece mounted on the stroke control rod.

FIG. 20 is a plan view showing in isolation, the instant device's stroke control and rod sleeve through which the stroke control rod passes.

FIG. 21 is another sectional view showing in isolation the instant device's stroke control rod encased in its sleeve.

A DESCRIPTION OF THE PREFERRED EMBODIMENT

Figure 1:
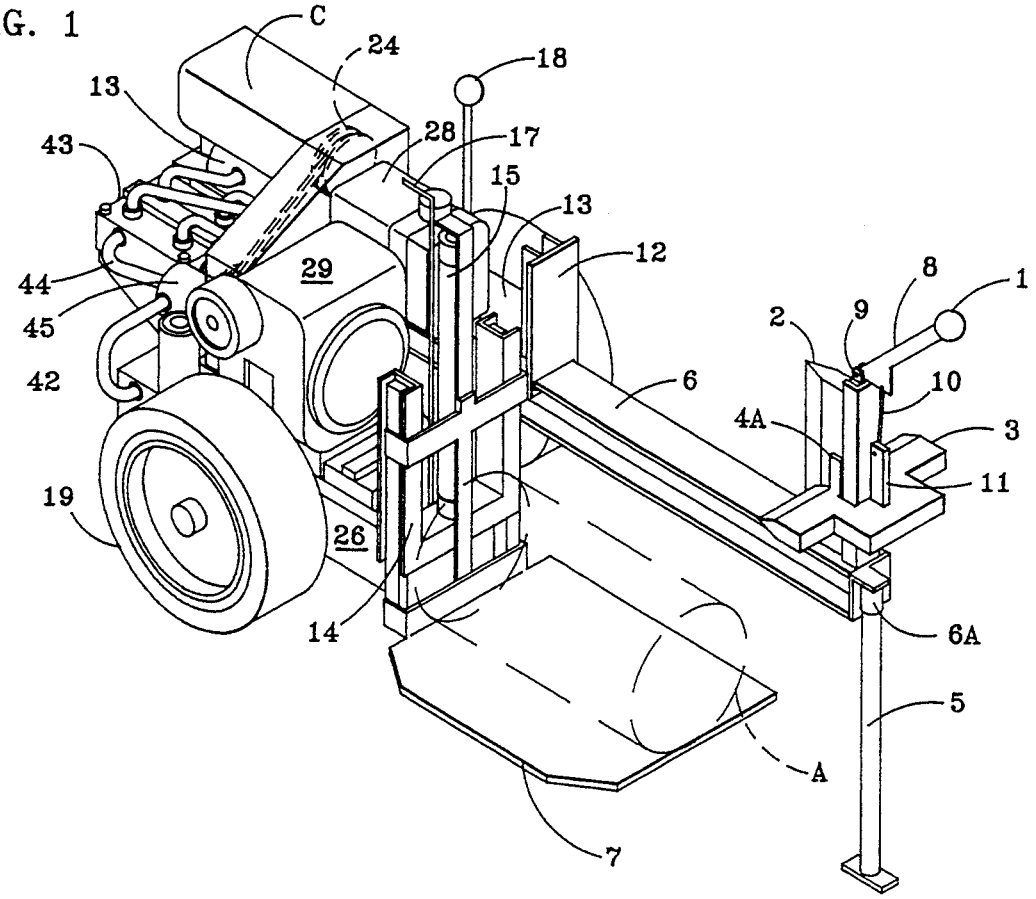
FIG. 1 is a perspective view of the instant device with mounted generator.
Figure 2:
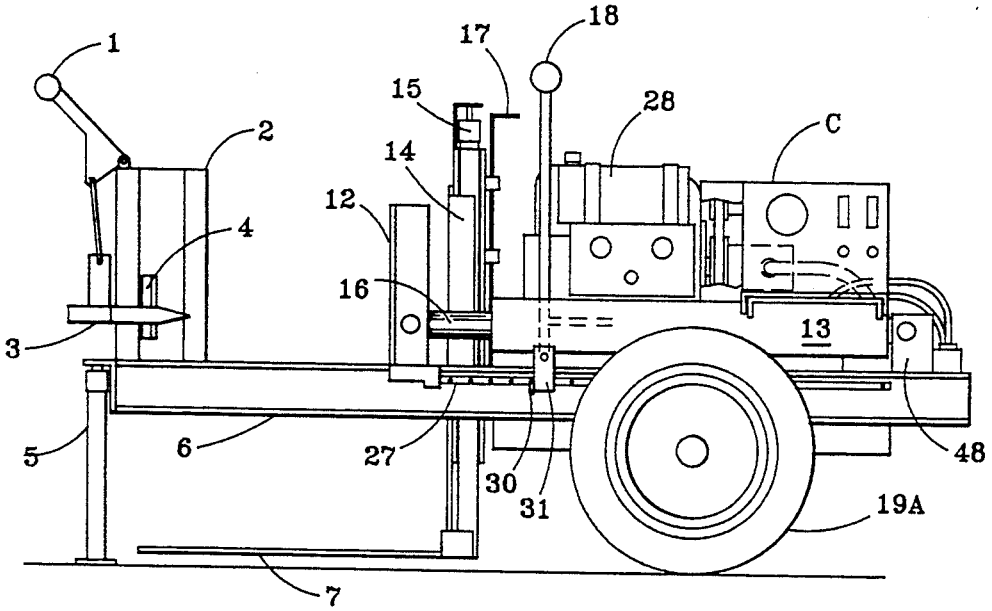
FIG. 2 is a plan view of the instant device with mounted generator.
Figure 3:
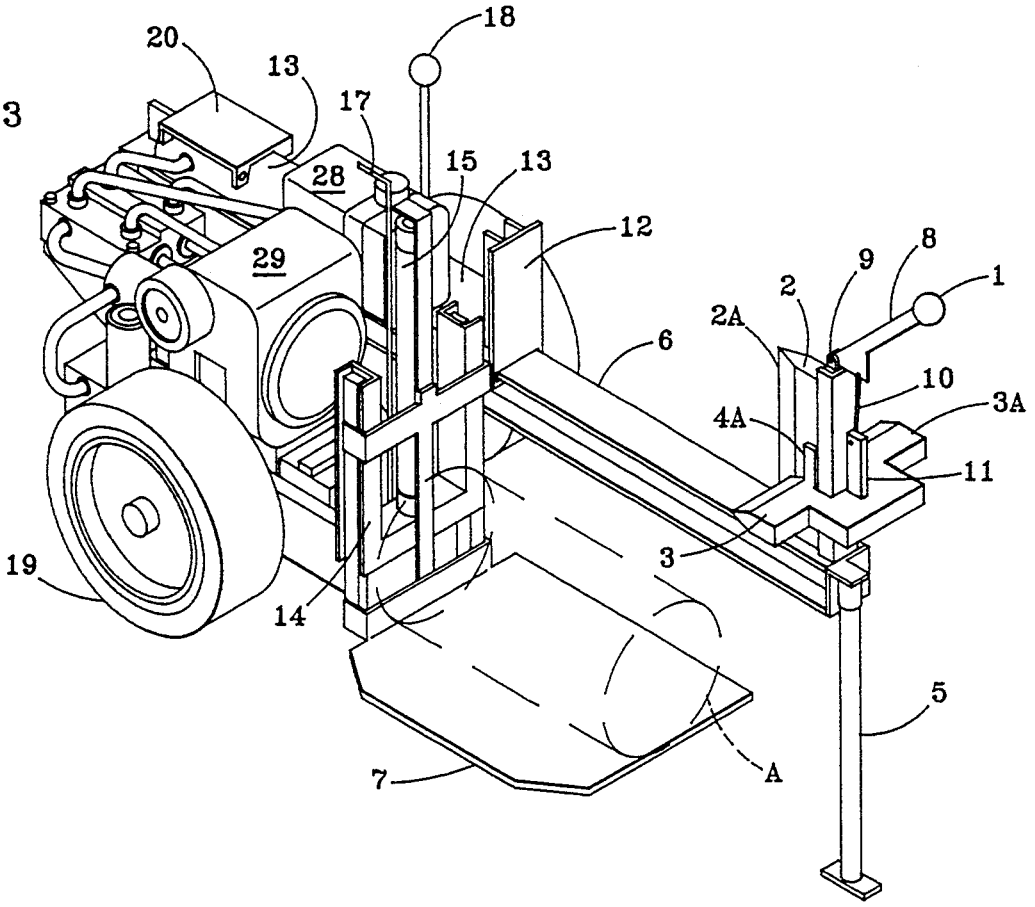
FIG. 3 is a perspective view of the instant invention without a mounted generator.
Figure 4:
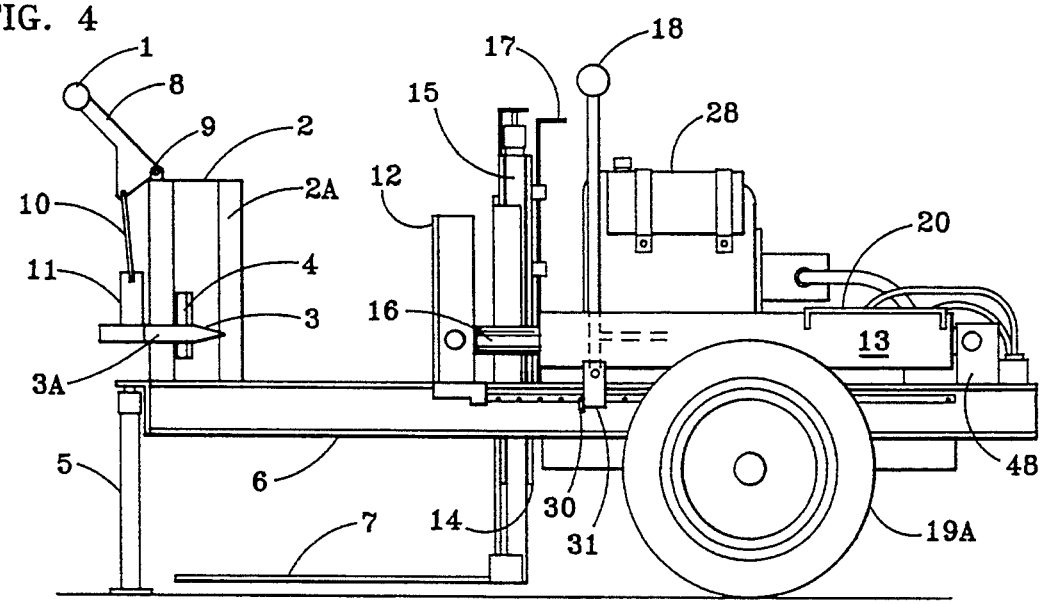
FIG. 4 is a plan view of the instant device without a mounted generator.
Figure 31:
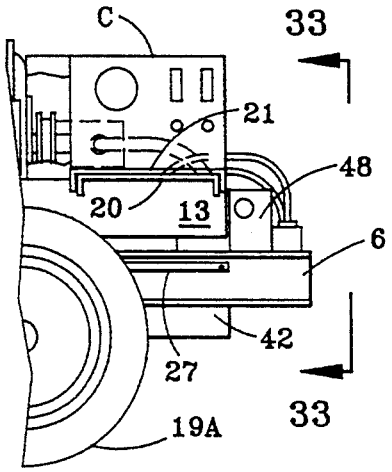
FIG. 31 is a plan view in isolation showing a generator mounted on a swivel plate atop the instant device's mounting plate.
Figure 32:
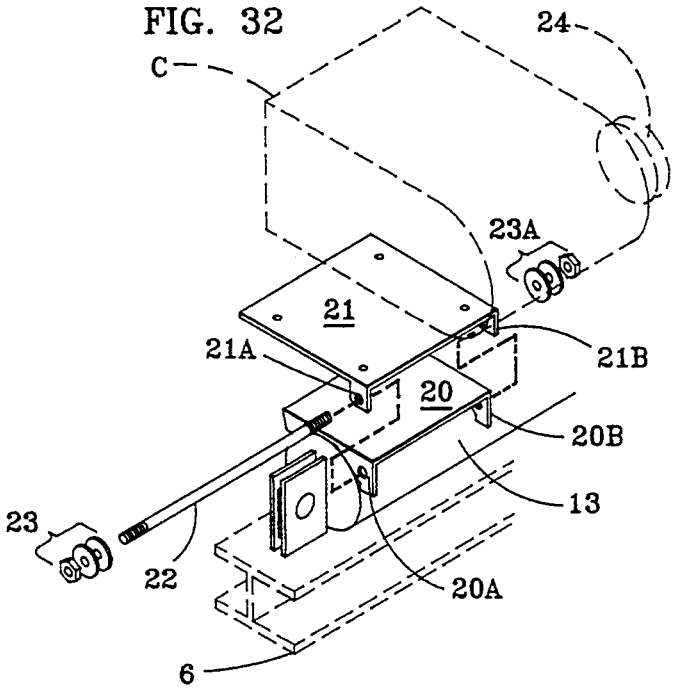
FIG. 32 is an exploded view in isolation of the instant device's generator mounting and swivel plates.
Figure 33:
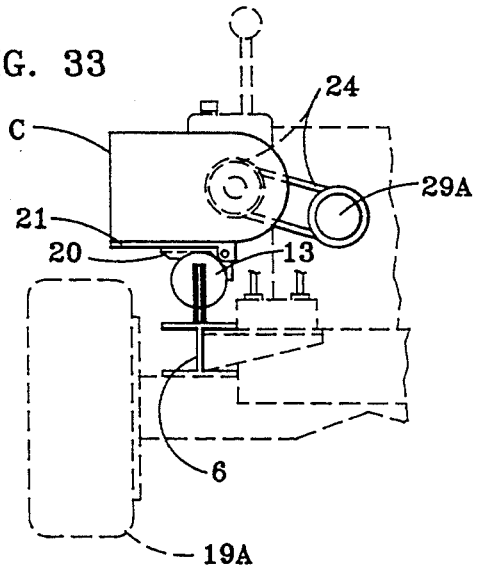
FIG. 33 is a rear view in isolation of the part of the instant device upon which a generator is mounted showing how the generator would be connected by a belt pulley to the instant device's gas driven motor.
Figure 34:
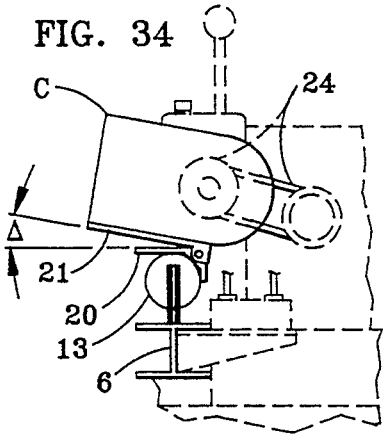
FIG. 34 illustrates how lifting the swivel plate from the mounting plate releases tension in the belt pulley to facilitate removal of the generator from or alternatively placement of the generator upon the instant device's mounting plate.

FIG. 1, a perspective view of the whole of the instant device shows generator C mounted on the device. FIG. 2 is a plan view of the instant device holding a generator C. The instant device's capability in respect of accommodating a generator in the manner herein to be described is but the first of a series of new, highly useful and unique features of the device. Pulley belt 24 is attached to generator C as well as to power driven motor 29 by way of simultaneous affixation to a drive wheel **29*a* on motor 29 and a driven generator wheel 29*a*, x in drawing on generator C. The generator C is shown in FIG. 33 as mounted on swivel plate 21 in turn mounted on mounting plate 20 located in the rear portion of the device and mounted on piston housing 13. The locus of mounting plate 20 on the device is also illustrated in FIGS. 3 and 4 which depict the instant device with the generator C as well as swivel plate 21 removed therefrom. Swivel rod 22 is inserted through holes 21*a*, 20*a*, 21*b* and 20*b* of plates 20 and 21 and secured by nuts and washers 23 and nuts and washers 23*a* as may all be noted with resort to FIG. 32. Generator C is affixed to plate 21 via screw and bolt assemblys through the base of Generator C and holes in plate 21** as are also seen in FIG. 32. The mounted generator C is shown in plan view in FIG. 31 as well as in FIG. 33, a sectional rear view of the instant device serving to isolate generator C and the manner in which it is mounted. FIG. 34 serves to illustrate how generator C can readily be mounted on or removed from the remainder of the instant device.

Figure 5:
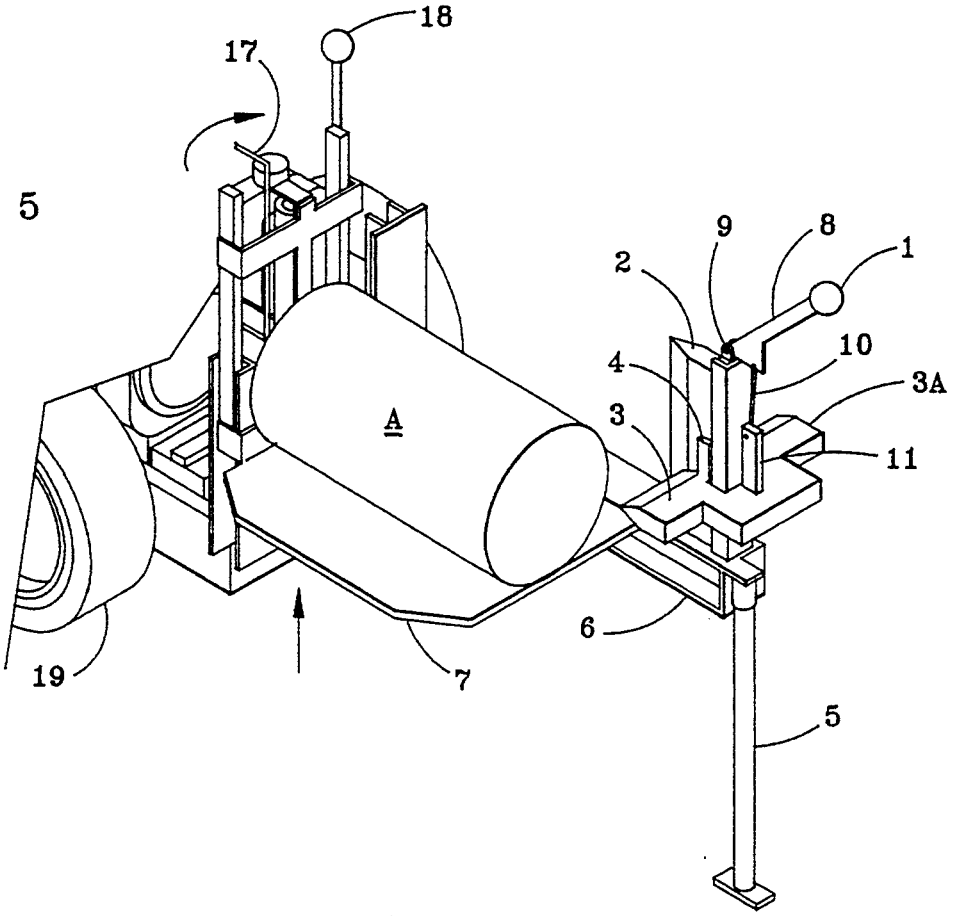
FIG. 5 is a perspective view of, in isolation, the instant device's hydraulically powered log elevator assembly showing a log lifted off the ground.
Figure 6:
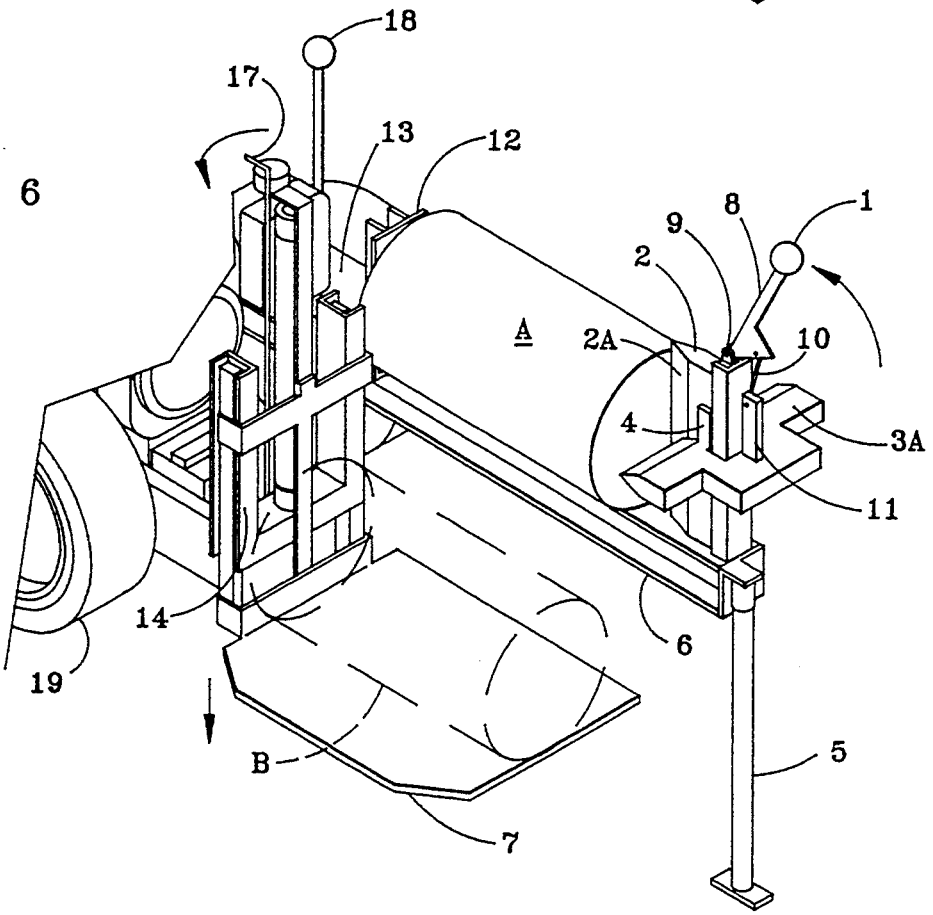
FIG. 6 shows the log of FIG. 5 on the instant device's splitting track ready to be split after first adjusting the level of the horizontal plane portion of the instant device's splitting wedge and lowering the instant device's log elevator assembly back down to the ground.
Figure 7:
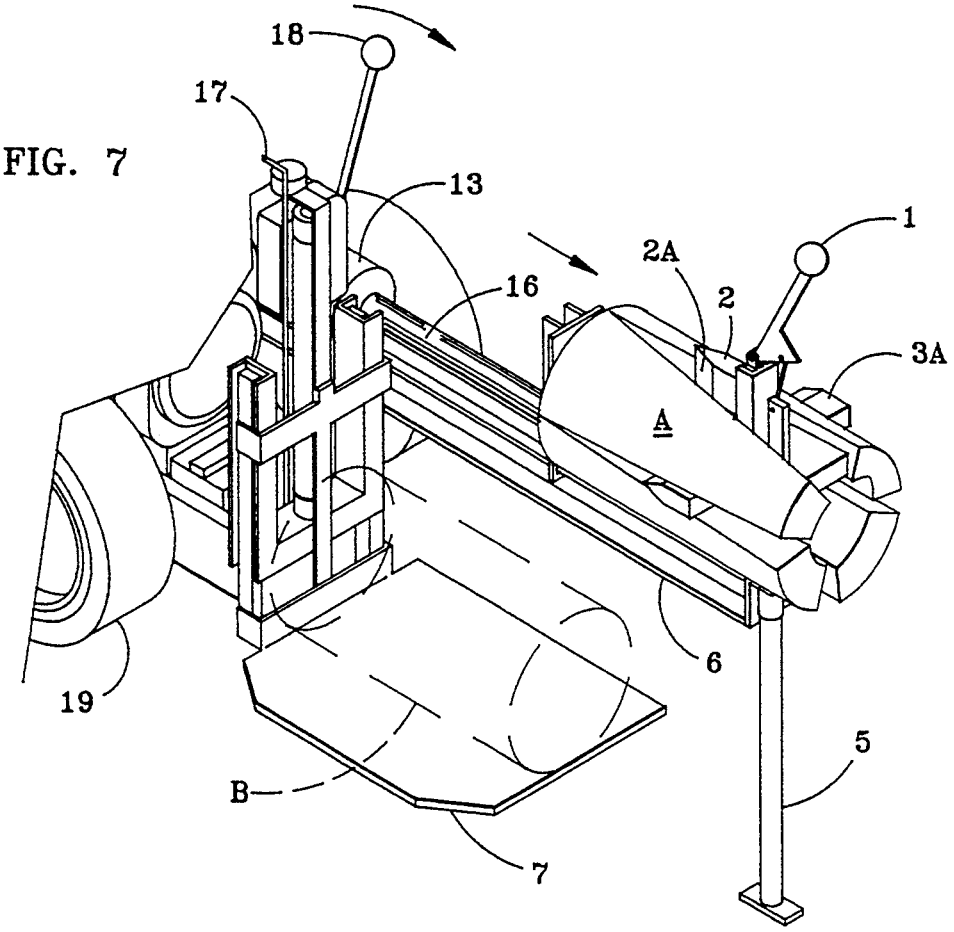
FIG. 7 shows a log being split in perspective view.
Figure 8:
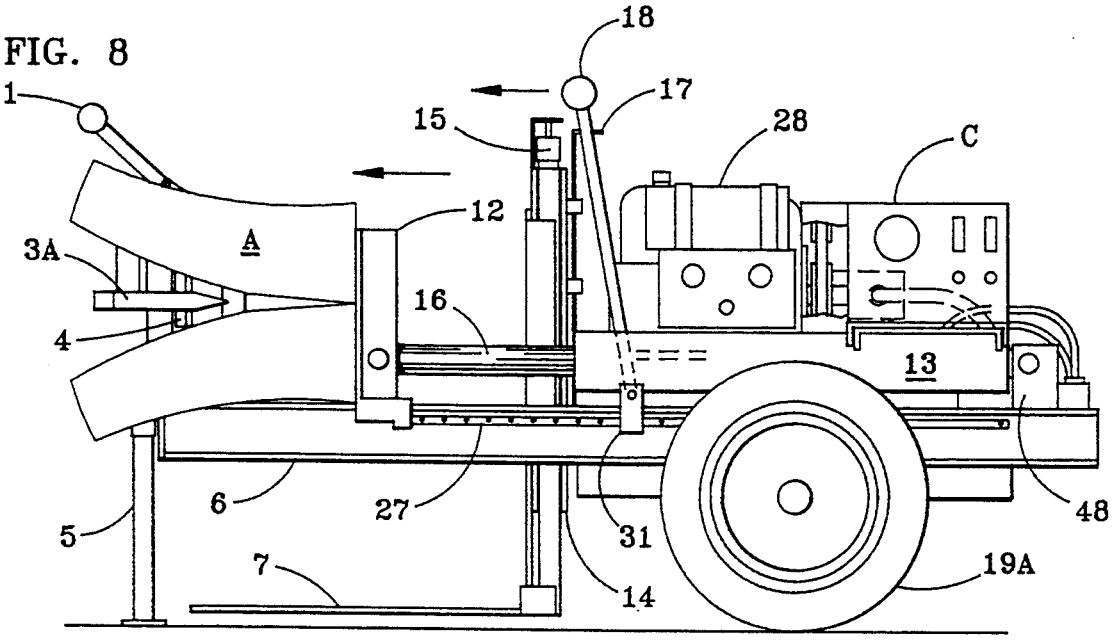
FIG. 8 shows a log being split in plan view.
Figure 9:
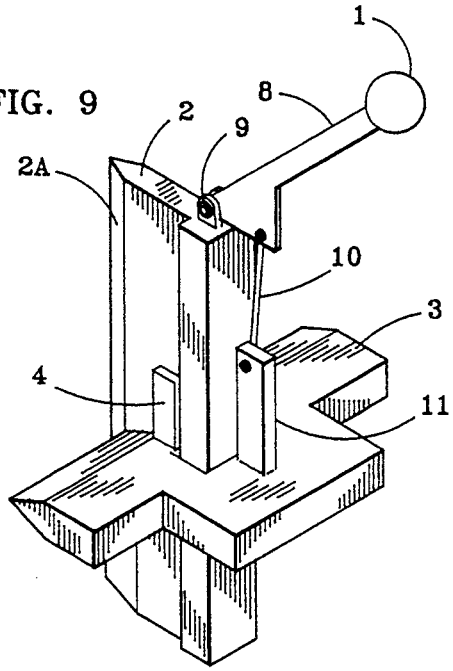
FIG. 9 is a perspective view isolating the instant device's four-way splitting wedge.
Figure 10:
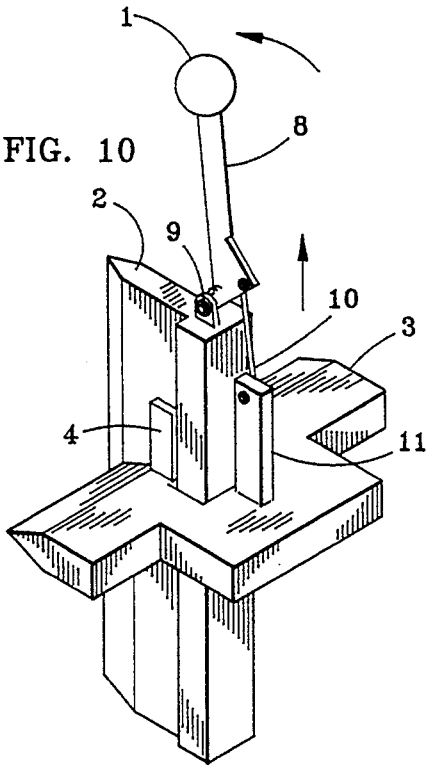
FIG. 10 shows what is shown in FIG. 9 but shows also how upward lifting of the lever mounted on the instant device's four-way splitting wedge causes elevation of its horizontal wedge component.
Figure 11:
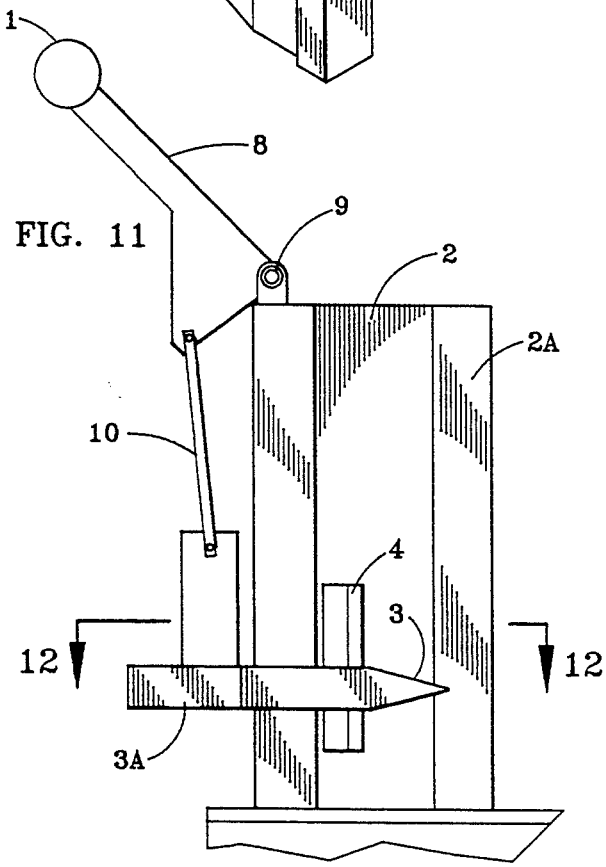
FIG. 11 is a plan view of what is shown in FIG. 9.
Figure 12:
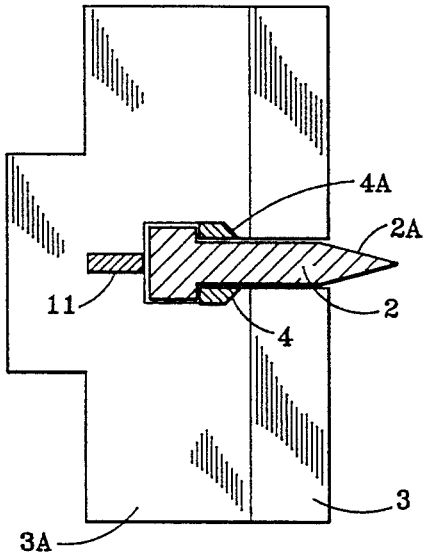
FIG. 12 is a sectional view through the vertical wedge component of the instant device's four-way splitting wedge.
Figure 13:
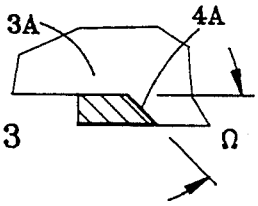
FIG. 13 shows in isolated sectional view the angle of inclination of the anteriormost portion of the vertical guide blade component of the instant device's four-way splitting wedge.
Figure 14:
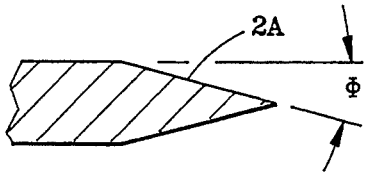
FIG. 14 shows in isolated sectional view the angle of inclination of the bladed portion of the vertical wedge component of the instant device's four-way splitting wedge.
Figure 15:
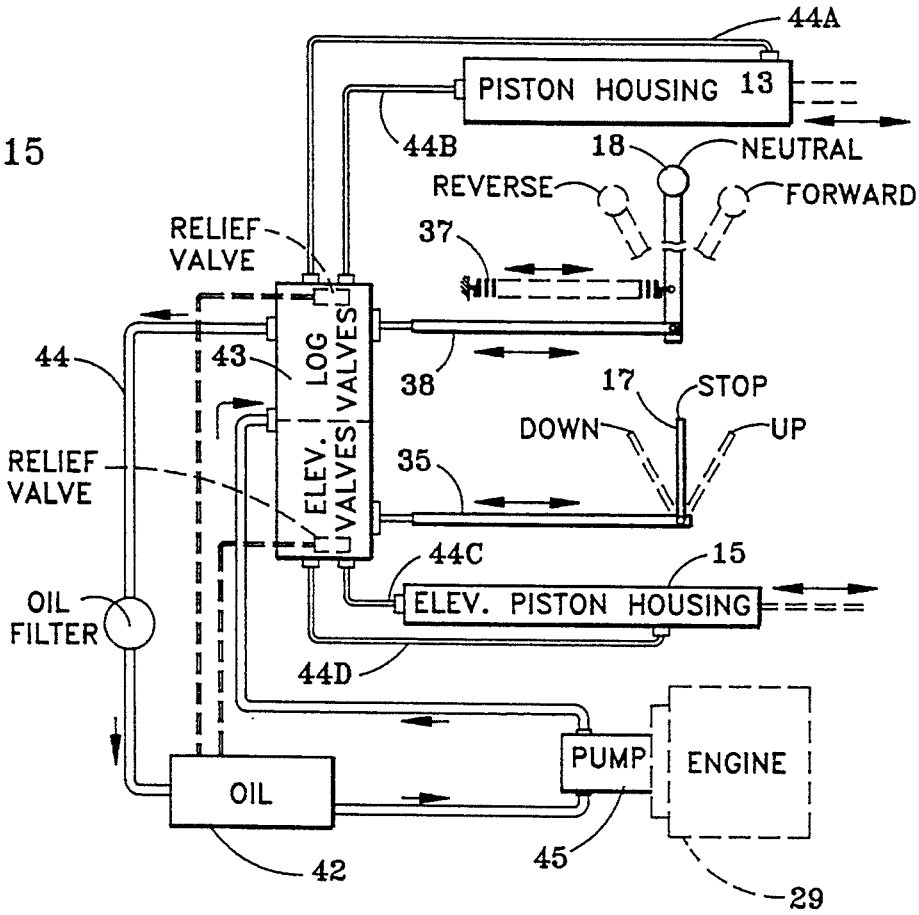
FIG. 15 is a schematic drawing of the instant device's hydraulics, elevator system and stroke control system.
Figure 16:
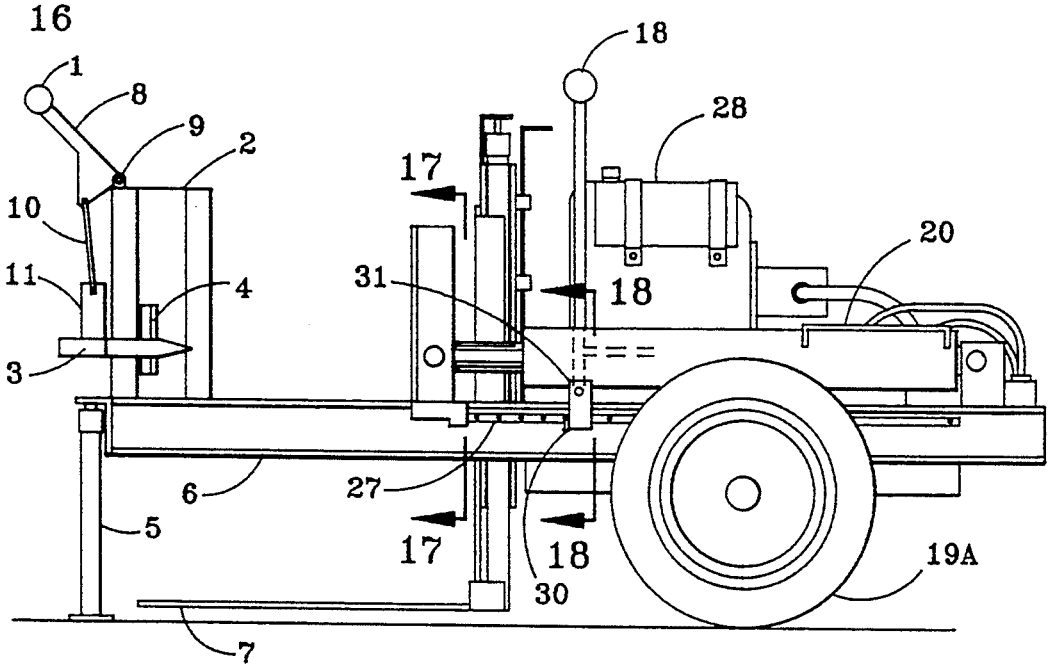
FIG. 16 is a plan view showing the instant device's stroke control rod, lever and pin.
Figure 22:
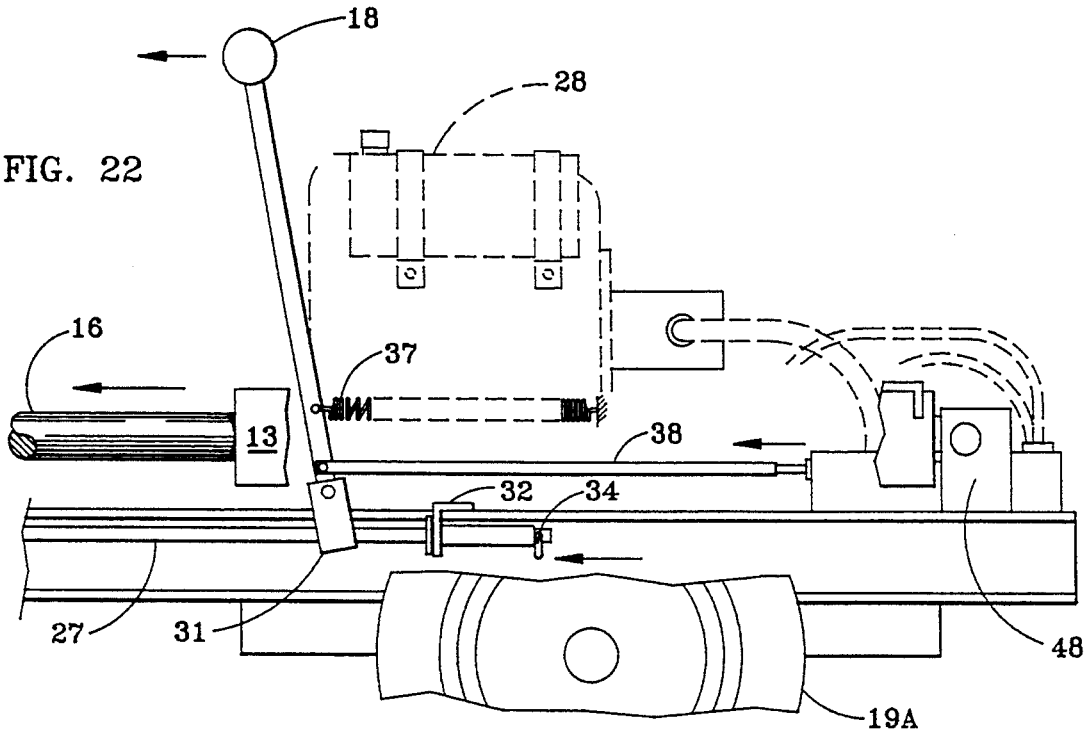
FIG. 22 is a plan view showing the forward motion of the shaft of the instant device's log pushing piston when its stroke control lever is pushed forward.
Figure 23:
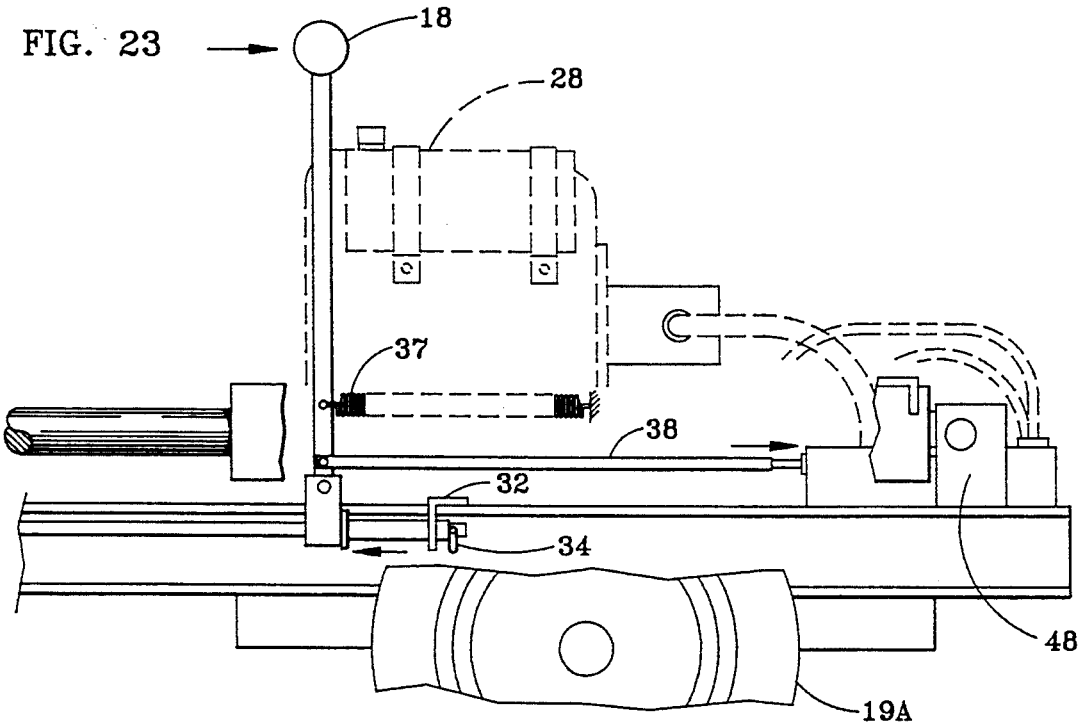
FIG. 23 is a plan view showing the stasis of the instant device's log pushing piston when the device's stroke control lever is in a neutral position. Also seen is the rod leading from the stroke control lever to the instant device's hydraulic controls.
Figure 24:
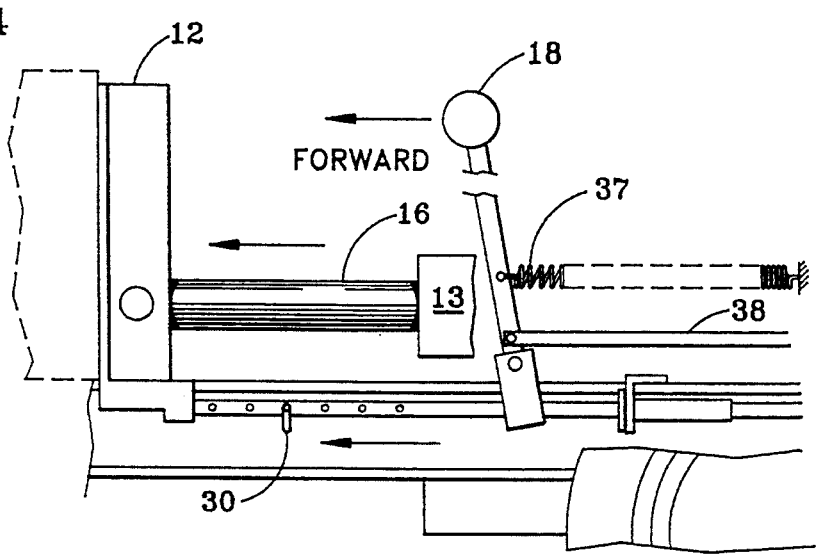
FIG. 24 is a plan view showing in isolation, the forward motion of the instant device's log pushing piston when the device's stroke control lever is pushed forward.
Figure 25:
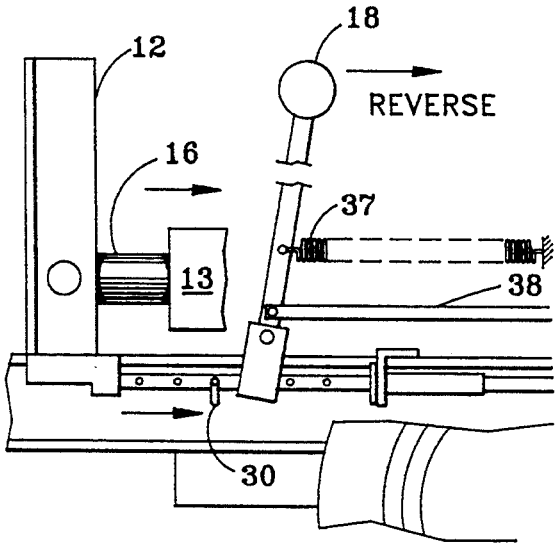
FIG. 25 is a plan view showing in isolation the reverse motion of the instant device's log pushing piston when its stroke control lever is pulled back by the compression of a spring mounted to the lever and the chassis of the device after the operator who would have initially pushed the lever forward to split a log, lets go of the lever with his hand.
Figure 26:
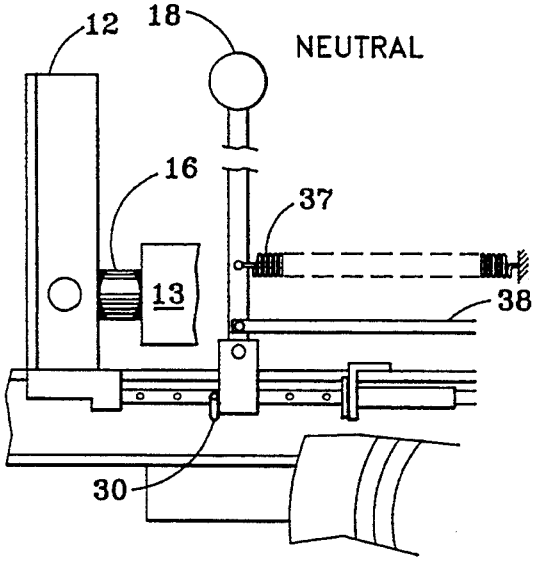
FIG. 26 is a plan view showing in isolation the manner in which a stop pin placed within a hole located in the instant device's stroke control rod causes the device's stroke control lever to achieve neutral position and thus stop the motion of the log pushing piston.
Figure 27:
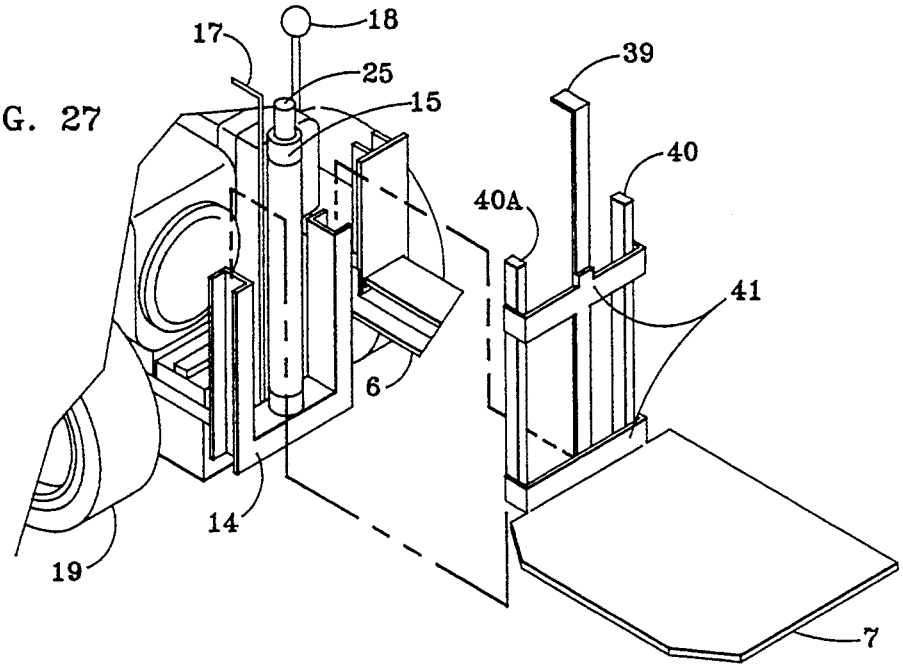
FIG. 27 is a perspective view showing in disassembled isolation, the instant device's log elevator component.
Figure 28:
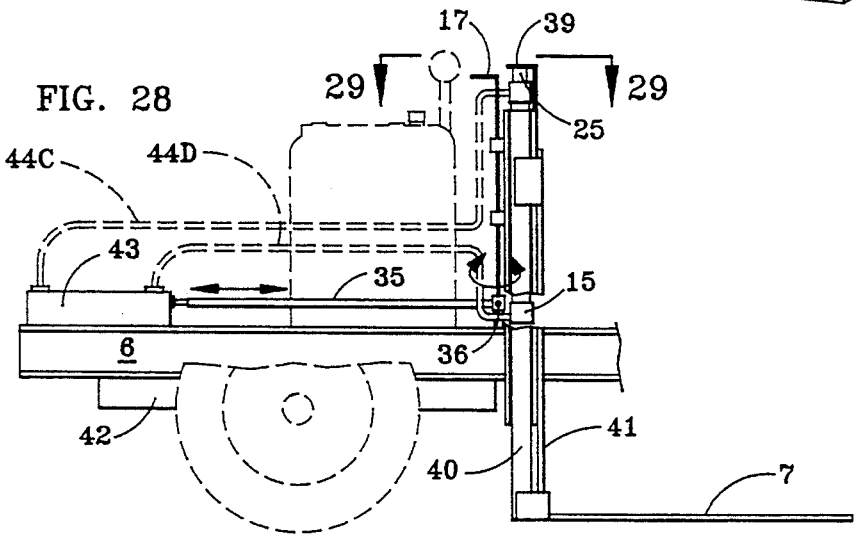
FIG. 28 is a plan view of the instant device's log elevator lift plate and hydraulics.
Figure 29:
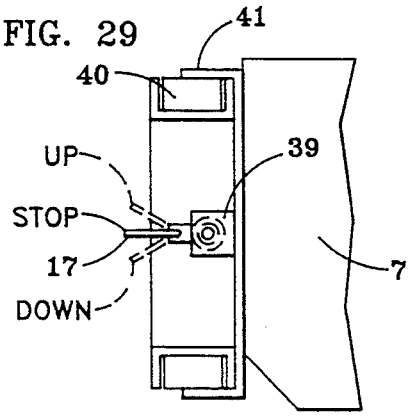
FIG. 29 is a top view of the instant device's log elevator control lever and the three positions it can assume as regards operation of the log elevator.
Figure 30:
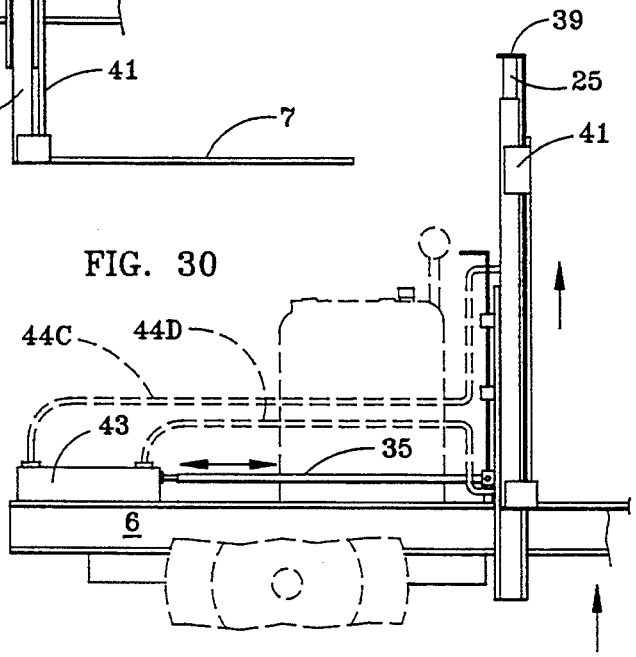
FIG. 30 is a plan view showing the rod leading from the instant device's log elevator control lever to the instant device's hydraulic controls and the device's log elevator lift plate in the up position.

Generator C is placed on plate 21 affixed as noted above to plate 20. Then plate 21 is lifted through enough of an angle and away from plate 20 to allow a slack pulley belt 24 to be lifted on wheels 29*a* and x respectively. Then plate 21 is lowered through an angle and to the face of plate 20 thus creating the tension in pulley belt 24 needed to drive wheel x via wheel 29*a* when motor 29 is energized so as to in turn operate generator C. The mounting process is simply reversed in order to remove generator C from plate 21. FIG. 1 also shows yet another of the instant device's new, extremely useful and unique feature, to wit, the device's adjustable four-way splitting wedge anchored to the front of the device's woodsplitting track 6 above the insertion of support post 5 into a cylindrical receptacle 6*a* located at the anteriormost end of woodsplitting track 6. FIG. 9 is a perspective view of the adjustable wedge. It is made up of a vertical splitting blade weldment 2 and vertical blade 2*a*. It is also made up of a horizontal splitting blade weldment 3*a* and horizontal blade 3. FIG. 11 is a right sided plan view of what is seen in FIG. 9. The adjustable wedge has a positioning handle weldment 8 with a handle knob 1 which handle 8 is affixed via pivot pin assembly 9 to the top surface of vertical splitting blade weldment 2. Pushing knob 1 through all or part of some angle as shown in FIG. 10 causes handle weldment 8 to lift up tie rod 10 affixed to pivot block 11 permanently affixed to horizontal splitting blade weldment 3*a* which in turn causes pivot block 11 and weldment 3*a* to also be lifted upwards. This adjustment feature facilitates four-way splitting of logs into pieces of varying sizes. FIG. 12 shows in sectional view in particular blade guides 4 and 4*a* respectively. These guides 4 and 4*a* serve to prevent the erstwhile adherence of the front portions of logs being split to the adjustable wedge itself, an outcome that would result in the crushing of logs sought to be split often into useless pieces under the pressure exerted by log pushing piston plate 12 on the rear portion of such logs. By virtue of the presence of guides 4 and 4*a*, splitting without crushing virtually always occurs. FIG. 13 is a close up view of the angle of inclination  of guide 4***a* which is the same as that of guide 4. FIG. 14 shows the angle of inclination  of vertical blade 2***a* which is the same on both sides of blade 2*a*. It is also the same as the angle of inclination from above of horizontal blade 3 and from below of horizontal blade 3. FIG. 1 as well as FIGS. 2–8 illustrate a third of the instant device's highly useful and unique features, namely, the device's log lifting elevator assembly. A log A on the ground is rolled onto elevator plate 7 and then as per FIGS. 5 and 6 is hydraulically lifted to the level of woodsplitting track 6 to be pushed by piston plate 12 given impetus by piston shaft 16 attached to a piston housed in piston housing 13 into blades 3 and 2*a* and guides 4 and 4*a* of the device's adjustable four-way splitting wedge. Elevator plate 7 is then hydraulically lowered to the ground to receive yet another log B as can be seen in FIG. 6. FIG. 7 is a perspective view of log A being split as noted above. FIG. 8 is a plan view of log A being split as noted above. FIG. 27 shows elevator plate 7 welded to elevator plate weldment 41 in turn welded to guide sides 40 and 40*a* and post 39 fits into permanent mounting sleeve assembly 14 permanently affixed to the chassis of the instant device. One method of assembly is to fit the whole assembly absent the upper bar portion of weldment 14 and top piece of post 39 up and through mounting sleeve assembly 14 and then weld the upper bar of weldment 14 and top piece of post 39 permanently to guide sides 40 and 40*a* and to the top of post 39 respectively as shown in FIG. 27. Elevator control lever 17 shown in FIGS. 27–28 and 30 is turned one way to lift elevator plate 7, another way to lower elevator plate 7 and lever 17 has a neutral position as well as can be seen in FIG. 29. Lift plate piston shaft 25 affixed to a piston held within piston housing 15 seen in FIG. 27 pushes up on the top piece of post 39 to lift elevator plate 7 when elevator control lever 17 is turned so as to lift elevator plate 7 as can be seen in FIG. 30. Elevator control lever 17's capability as noted in FIG. 29 is actuated by control lever rod 35 connected to the instant device's hydraulics housed within compartment 43. FIG. 30 shows hydraulic lines 44*c* and 44*d* engaging piston housing 15. Rod 35 connected to hydraulics within compartment 43 and lines 44*c* and 44*d* engaging housing 15 are also shown in FIG. 28. This elevator feature not only enables frail persons to readily utilize the instant device to load logs of large circumference for splitting but also enables such persons to stabilize the instant device without having to hold it or lift it when post 5 is removed from cylindrical receptacle 6*a* as, for example, when one wishes to move the instant device from one place to another. All that is required for purposes of such stabilization is to turn control lever 17 so as to lower elevator plate 7 to ground level. Yet another of the instant device's new, highly useful and unique features is its built in stroke control system. Stroke control lever 18 is connected via stroke control rod 38 to the device's hydraulics housed within compartment 43 as shown in FIG. 19. Moreover, lever 18 is attached to spring 37 which is in turn anchored to the chassis of the device behind where the device's gas tank 28 is to be found mounted. FIG. 16, a plan view of the instant device serves to evidence locations within the span of the instant device as are illustrated in sectional FIGS. 17 and 18. Lever 18 as shown in FIG. 18 is attached by way of a pin and rod 46 assembly to a stop plate 31 which by virtue of the pin and rod 46 assembly pivots in synchrony with lever 18. This system is mounted by way of mounting plates 47 to woodsplitting track 6. FIG. 18 also shows how a stroke length control rod 27 is held within a canal bored through the base of stop plate 31. FIG. 17 shows how stroke length control rod 27 is held by piston plate 12 which is itself sleeve-mounted to woodsplitting track 6. Stroke length control rod 27 has a series of holes in it as seen in FIG. 19 for purposes of inserting into any one of them, a pin 30. Rod 27 is circumscribed just posterior to its mid-portion by movable sleeve 33 which is in turn held within a canal in sleeve mounting plate 32 affixed to track 6 as can be shown with reference to FIGS. 20 and 21. There is able to be seen in FIG. 19, a stop pin 34 permanently affixed to the posterior end of rod 27. Operation of this stroke control feature of the device is illustrated with reference to FIGS. 22, 23, 24, 25 and 26. The purpose of the holes in rod 27 is to permit control over the length of the reverse stroke and correspondingly the forward stroke of piston shaft 16 to which log pushing plate 12 is attached. The length of the stroke is determined by the operator with reference to the length of the log pieces placed on track 6 to be split. As is the case presently with respect to current art, a piston and plate assembly pushes a log into a wedge for spitting purposes and when splitting is completed, the piston and plate go back in reverse to a start point through a distance often well in excess of the length of a log that would have been split and then goes forward for a distance until impacting a second log to be split. Hence, there is considerable forward and reverse motion where no splitting work is being accomplished. This extra motion is time consuming and wastes energy. The instant stroke control system totally obviates such wasted motion. An operator places a pin 30 into a hole in rod 27. The choice of which hole to select is dependent on how long a stroke the operator desires which in turn depends on the estimated average length of a set of logs to be split. Short strokes are desired for long logs. Long strokes are desired for short logs. A pin 30 placed in a hole in rod 27 closer to mounting plate 32 will result in a shorter stroke than will pin placement in a hole in rod 27 closer to log pushing plate 12. As seen in FIG. 24, lever 18 is pushed forward by an operator. Stroke control rod 38 connected to the device's hydraulics within compartment 43 causes piston rod 16 within housing 13 to push log pushing plate 12 forward to impact a log to be split and push the log into the device's adjustable four-way splitting wedge. The operator after splitting is accomplished, releases lever 18 and lever 18 is pulled as per FIG. 25 into its reverse position by compression within anchored spring 37 previously stretched when lever 18 was pushed forward. When lever 18 is pulled into its reverse position, stroke control rod 38 connected to the device's hydraulics within compartment 43 causes piston rod 16 to move in reverse within housing 13. As rod 16 moves either forward or in reverse, so does log pushing plate 12 and in turn stroke length control rod 27 connected thereto as earlier pointed with reference to FIG. 17. But, placement of pin 30 into one of the holes in rod 27 retards the reverse movement of piston rod 16 by impacting stop plate 31 as seen in FIG. 26 which causes lever 18 to be rotated from its reverse position as shown in FIG. 25 to a neutral position as seen in FIG. 26. In summary with reference to FIG. 26, pin 30 in rod 27 impacts plate 31 causing it to pivot forward and lever 18 in turn to likewise pivot forward enough to achieve neutral status and terminate the reverse motion of piston rod 16. As earlier mentioned, the chosen placement of pin 30 within one of the holes in rod 27 determines the length of the reverse stroke motion of piston rod 16 before impact between pin 30 and plate 31 causes lever 18 to assume neutral status. FIGS. 22 and 23 illustrate yet another aspect of the device's stroke control system, namely a novel safety feature. Permanently positioned pin 34 is located near the end of rod 27 at a distance from the end of rod 27 sufficient to enable it to function so as to effectively retard the forward motion of piston rod 16 in order to prevent log push plate 12 from ever touching the device's adjustable four-way splitting wedge. Forward motion of rod 16, plate 12 and in turn rod 27 eventually causes pin 34 to impact movable sleeve 33 and in turn push sleeve 33 into stop plate 31 as is shown with reference to FIGS. 22 and 23. Moveable sleeve 33 impacts stop plate 31 with force sufficient in magnitude to cause plate 31 to pivot back and correspondingly lever 18 held by an operator to pivot back to a neutral position to thus retard the forward motion of rod 16 and prevent impact of plate 12 with the device's splitting wedge. FIG. 15 is a schematic depiction of the instant device's hydraulics. The hydraulics consist of a two spool four-way three position spring loaded valvular component housed in hydraulics compartment 43. This component is internally spring loaded so as to tend to hold stroke control rod 38 and elevator control lever rod 35 and correspondingly stroke control lever 18 and elevator control lever 17 in a neutral position so as to impede fluid flow. One spool services the device's stroke control system. The other, services the device's elevator commands. The valve provides up and down elevator capability and back and forth stroke control capability in terms of its ability to direct fluid flow. Its three position capability serves to accommodate up, down or back, forth and neutral commands. Line **44*a* serves to introduce hydraulic fluid into the anterior portion of piston housing 13 causing reverse movement of the piston within housing 13 when stroke control lever 18 is in the reverse position by way of action via stroke control rod 38. Similarly, by way of appropriate action via stroke control rod 38, when stroke control lever 18 is in the forward position, hydraulic fluid via hydraulic line 44*b* enters the posterior position of housing 13 causes piston shaft 16 to move forward and push fluid in front of housing 13 back through line 44*a* to compartment 43 when stroke control lever 18 is in the reverse position. Along a similar vein, when elevator control lever 17 is rotated to the down position, control lever rod 35 attached thereto causes hydraulic fluid to enter housing 15 via line 44*d* to push down on the elevator piston 25 within housing 15 causing piston shaft 25 to drop downward while fluid passes therefrom through line 44*c* back to compartment 43. When lever 17 is rotated to the up position, fluid enters housing 15 through line 44*c* and forces fluid out through line 44*d* back to compartment 43 as the piston within housing 15 and accordingly piston shaft 25 is then pushed upwards by the force of the fluid from line 44*c*. Moreover, engine 29 actuates pump 45 to force fluid into compartment 43 for availability to operate the device's stroke control and elevator systems as described above. Fluid leaves compartment 43 via return line 44 that passes through a filter to a collection chamber 42 for return of the fluid in filtered state to the station of pump 45. Two relief valves within compartment 43 serve to run excess fluid pumped therein back to chamber 42 at any given instant in time when uptake by the device's stroke control and/or elevator system of fluid is less than the volume of fluid then available within compartment 43 and not then yet removed therefrom via line 44**. Other embodiments of the instant invention contemplate electrically powered rather than hydraulic means for driving the log pushing piston and elevator piston described above.

What is claimed is:

1. A modified woodsplitter comprising:

a. a generator mounting plate permanently affixed to a log pushing piston housing unit which said housing unit is permanently affixed to a mounting block and which said mounting block is permanently affixed to a log splitting track permanently mounted on a base held by two equivalent support structures, one of said support structures on each side of said base;

b. a swivel plate for receipt of said generator attached to said mounting plate on one side by way of a first pin and bolt assembly unit;

c. a vertically inclined wedge anteriorally triangular in shape affixed to the anteriormost portion of said log splitting track;

d. a first lever attached to the top side of said vertically inclined wedge by way of a second pin and bolt assembly unit;

e. a tie rod permanently attached to the back side of said first lever;

f. a pivot block permanently attached to said tie rod;

g. a horizontally inclined wedge anteriorally triangular in shape, the top side of which said horizontally inclined wedge is permanently attached to the bottom side of said pivot block and which said horizontally inclined wedge abuts the lateral and posterior sides of said vertically inclined wedge but not the said anteriormost triangular shaped portion of said vertically inclined wedge;

h. a first blade guide with length less than the length of said vertically inclined wedge, the medial side of which said first blade guide is permanently affixed to one of the two lateral sides of said vertically inclined wedge with the lateral side of said first blade guide in apposition to one of two medial sides of said horizontally inclined wedge;

i. a second blade guide with length less than the length of said vertically inclined wedge, the medial side of which said second blade guide is permanently affixed to the other of the said two lateral sides of said vertically inclined wedge with the lateral side of said second blade guide in apposition to the other of said two medial sides of said horizontally inclined wedge;

j. a front face of said first blade guide that is throughout the length of said first blade guide inclined at an angle less than 90 degrees from said first blade guide's said lateral side and not parallel to said first blade guide's posterior face which said posterior face is perpendicular to said first blade guide's said lateral side and said medial side;

k. a front face of said second blade guide that is throughout the length of said second blade guide inclined at an angle less than 90 degrees from said second blade guide's said lateral side and not parallel to said second blade guide's posterior face which said posterior face is perpendicular to said second blade guide's said lateral side and said medial side;

l. a log pushing piston housed within said log pushing piston housing unit the head of which said log pushing piston extends out from the anterior face of said log pushing piston housing unit;

m. a log pushing plate permanently attached to said head of said log pushing piston and permanently attached to said log splitting track;

n. a first rod containing a plurality of holes permanently mounted to said log splitting track by way of a movable sleeve permanently mounted to said track which said first rod is likewise permanently mounted to the base of said log pushing plate;

o. a pivotable stop plate permanently mounted by way of a third pin and bolt assembly unit to a first orthogonally shaped mounting unit which said first orthogonally shaped mounting unit is permanently mounted to said track;

p. a pivotable second lever permanently connected to said pivotable stop plate by way of said third pin and bolt assembly and permanently mounted by way of said third pin and bolt assembly unit to a second orthogonally shaped mounting unit which said second orthogonally shaped mounting unit is permanently mounted to said track;

q. a stretchable, compressible spring permanently connected to said pivotable second lever which said spring is also anchored to said log pushing piston housing unit;

r. a second rod permanently connected to said pivotable second lever and permanently connected to valvular means for actuating the flow of hydraulic fluid under pressure from within an hydraulic fluid and hydraulic valvular housing unit to and from said log pushing piston housing unit by way of a first pair of hydraulic fluid lines;

s. a log lifting elevator plate the long axis of which is perpendicular to the long axes of each of two parallel support arm permanently connected to said elevator plate;

t. an orthogonally shaped sleeve unit permanently mounted to said base held by said two support structures adjacent said log splitting track;

u. an elevator piston housing unit connected by hydraulic fluid lines to said hydraulic fluid and hydraulic valvular housing unit which said elevator piston housing unit is permanently mounted to said orthogonally shaped sleeve unit and said base held by said two equivalent support structures;

v. an elevator piston housed within said elevator piston housing unit the head of which said elevator piston extends out of and up from the top of said elevator piston housing unit;

w. an orthogonally shaped piston head receiving plate permanently mounted to said elevator plate, the long axis of which said receiving plate is parallel to the long axes of said two parallel support arms;

x. a rotatable third lever permanently mounted to said elevator piston housing unit by way of a plurality of equivalent mounting blocks each containing a hole for receipt of said third lower and each permanently mounted to said elevator piston housing unit;

y. a third rod permanently connected to said rotatable third lever and permanently connected to said valvular means for actuating the flow of hydraulic fluid under pressure from within said hydraulic fluid and hydraulic valvular housing unit to and from said elevator piston housing unit by way of a second pair of hydraulic fluid lines.

2. A modified woodsplitter comprising:

a. a generator mounting plate permanently affixed to a log pushing piston housing unit which said housing unit is permanently affixed to a mounting block and which said mounting block is permanently affixed to a log splitting track permanently mounted on a base held by two equivalent support structures, one of said support structures on each side of said base;

b. a swivel plate for receipt of said generator attached to said mounting plate on one side by way of a first pin and bolt assembly;

c. a log pushing piston housed within said log pushing piston housing unit the head of which said log pushing piston extends out from the anterior face of said log pushing piston housing unit;

d. a log pushing plate permanently attached to said head of said log pushing piston and permanently attached to said log splitting track;

e. actuating means for activating the flow of hydraulic fluid within fluid lines leading to said log pushing piston housing unit which said hydraulic fluid causes said log pushing piston to move forward and backward within said log pushing piston housing unit.

3. A modified woodsplitter, comprising:

a. a log pushing piston housing unit which said housing unit is permanently affixed to a mounting block and which said mounting block is permanently affixed to a log splitting track permanently mounted on a base held by two equivalent support structures, one of said support structures on each side of said base;

b. a vertically inclined wedge anteriorally triangular in shape affixed to the anteriormost portion of said log splitting track;

c. a first lever attached to the top side of said vertically inclined wedge by way of a second pin and bolt assembly unit;

d. a tie rod permanently attached to the back side of said first lever;

e. a pivot block permanently attached to said tie rod;

f. a horizontally inclined wedge anteriorally triangular in shape, the top side of which said horizontally inclined wedge is permanently attached to the bottom side of said pivot block and which said horizontally inclined wedge abuts the lateral and posterior sides of said vertically inclined wedge but not the said anteriormost triangular shaped portion of said vertically inclined wedge;

g. a first blade guide with length less than the length of said vertically inclined wedge, the medial side of which said first blade guide is permanently affixed to one of the two lateral sides of said vertically inclined wedge with the lateral side of said first blade guide in apposition to one of two medial sides of said horizontally inclined wedge;

h. a second blade guide with length less than the length of said vertically inclined wedge, the medial side of which said second blade guide is permanently affixed to the other of the said two lateral sides of said vertically inclined wedge with the lateral side of said second blade guide in apposition to the other of said two medial sides of said horizontally inclined wedge;

i. a front face of said first blade guide that is throughout the length of said first blade guide inclined at an angle less than 90 degrees from said first blade guide's said lateral side and not parallel to said first blade guide's posterior face which said posterior face is perpendicular to said first blade guide's said lateral side and said medial side;

j. a front face of said second blade guide that is throughout the length of said second blade guide inclined at an angle less than 90 degrees from said second blade guide's said lateral side and not parallel to said second blade guide's posterior face which said posterior face is perpendicular to said second blade guide's said lateral side and said medial side;

k. a log pushing piston housed within said log pushing piston housing unit the head of which said log pushing piston extends out from the anterior face of said housing unit;

l. a log pushing plate permanently attached to said head of said log pushing piston and permanently attached to said log splitting track;

m. actuating means for activating the flow of hydraulic fluid within fluid lines leading to said log pushing piston housing unit which said hydraulic fluid causes said log pushing piston to move forward and backward within said log pushing piston housing unit.

4. A modified woodsplitter, comprising:

a. a log pushing piston housing unit which said housing unit is permanently affixed to a mounting block and which said mounting block is permanently affixed to a log splitting track permanently mounted on a base held by two equivalent support structures, one of said support structures on each side of said base;

b. a log pushing piston housed within said log pushing piston housing unit the head of which said log pushing piston extends out from the anterior face of said log pushing piston housing unit;

c. a log pushing plate permanently attached to said head of said log pushing piston and permanently attached to said log splitting track;

d. a first rod containing a plurality of holes permanently mounted to said log splitting track by way of a movable sleeve permanently mounted to said track which said first rod is likewise permanently mounted to the base of said log pushing plate;

e. a pivotable stop plate permanently mounted by way of a third pin and bolt assembly unit to a first orthogonally shaped mounting unit which said first orthogonally shaped mounting unit is permanently mounted to said track;

f. a pivotable lever permanently connected to said pivotable stop plate by way of said third pin and bolt assembly and permanently mounted by way of said third pin and bolt assembly unit to a second orthogonally shaped mounting unit which said second orthogonally shaped mounting unit is permanently mounted to said track;

g. a stretchable, compressible spring permanently connected to said pivotable second lever which said spring is also anchored to said log pushing piston housing unit;

h. a second rod permanently connected to said pivotable second lever and permanently connected to valvular means for actuating the flow of hydraulic fluid under pressure from within an hydraulic fluid and hydraulic valvular homing unit to and from said log pushing piston housing unit by way of a pair of hydraulic fluid lines;

i. actuating means for activating the flow of hydraulic fluid within fluid lines leading to said log pushing piston housing unit which said hydraulic fluid causes said log pushing piston to move forward and backward within said log pushing piston housing unit.

5. A modified woodsplitter, comprising:

a. a log pushing piston housing unit which said housing unit is permanently affixed to a mounting block and which said mounting block is permanently affixed to a log splitting track permanently mounted on a base held by two equivalent support structures, one of said support structures on each side of said base;

b. a log pushing piston housed within said log pushing piston housing unit the head of which said log pushing piston extends out from the anterior face of said log pushing piston housing unit;

c. a log pushing plate permanently attached to said head of said log pushing piston and permanently attached to said log splitting track;

d. a log lifting elevator plate the long axis of which is perpendicular to the long axes of each of two parallel support arms permanently connected to said elevator plate;

e. an orthogonally shaped sleeve unit permanently mounted to said base held by said two support structures adjacent said log splitting track;

f. an elevator piston housing unit connected by hydraulic fluid lines to said hydraulic fluid and hydraulic valvular housing unit which said elevator piston housing unit is permanently mounted to said orthogonally shaped sleeve unit and said base held by said two equivalent support structures;

g. an elevator piston housed within said elevator piston housing unit the head of which said elevator piston extends out of and up from the top of said elevator piston housing unit; h. an orthogonally shaped piston head receiving plate permanently mounted to said elevator plate, the long axis of which said receiving plate is parallel to the long axes of said two parallel support arm;

i. a rotatable lever permanently mounted to said elevator piston housing unit by way of a plurality of equivalent mounting blocks each containing a hole for receipt of said rotatable lever and each permanently mounted to said elevator piston housing unit;

j. a rod permanently connected to said rotatable lever and permanently connected to said valvular means for actuating the flow of hydraulic fluid under pressure from within said hydraulic fluid and hydraulic valvular housing unit to and from said elevator piston housing unit by way of a pair of hydraulic fluid lines;

k. actuating means for activating the flow of hydraulic fluid within fluid lines leading to said log pushing piston housing unit and to said elevator piston housing unit which said hydraulic fluid causes said log pushing piston to move forward and backward within said log pushing piston housing unit and which said hydraulic fluid also causes said elevator piston to move up and down within said elevator piston housing unit.

6. The modified woodsplitter of claim 1, whereby said first orthogonally shaped mounting unit and said second orthogonally shaped mounting unit are joined permanently together to form one mounting unit permanently mounted to said track.

7. The modified woodsplitter of claim 4, whereby said first orthogonally shaped mounting unit and said second orthogonally shaped mounting unit are joined permanently together to form one mounting unit permanently mounted to said track.

8. The modified woodsplitter of claim 1, whereby said rotatable third lever is mounted to the chassis of said modified woodsplitter.

9. The modified woodsplitter of claim 5, whereby said rotatable lever is mounted to the chassis of said modified woodsplitter.

* * * * *